US008416096B2

(12) United States Patent
Qiu et al.

(10) Patent No.: US 8,416,096 B2
(45) Date of Patent: Apr. 9, 2013

(54) SYSTEM AND METHOD OF CONTROLLING INDICATORS OF A PROPERTY MONITORING SYSTEM

(75) Inventors: Rongbin Qiu, Shanghai (CN); Baohua Shu, Shanghai (CN); Xiao Luo, Hubei (CN); Donald Edward Becker, Bradenton, FL (US); Laigui Qin, Sichuan (CN); Zhenhua Huang, Hunan (CN)

(73) Assignee: UTC Fire & Security Americas Corporation, Inc., Bradenton, FL (US)

( * ) Notice: Subject to any disclaimer, the term of this patent is extended or adjusted under 35 U.S.C. 154(b) by 1042 days.

(21) Appl. No.: 12/417,286

(22) Filed: Apr. 2, 2009

(65) Prior Publication Data

US 2010/0253531 A1 Oct. 7, 2010

(51) Int. Cl.
*G08B 3/00* (2006.01)
*G08B 5/00* (2006.01)
*G08B 7/00* (2006.01)

(52) U.S. Cl. ..... 340/691.3; 340/691.6

(58) Field of Classification Search ..... 340/691.6, 340/691.3

See application file for complete search history.

(56) References Cited

U.S. PATENT DOCUMENTS 4,283,773 A * 8/1981 Daughton et al. ..... 700/3
5,608,375 A * 3/1997 Kosich ..... 340/293
6,459,919 B1 10/2002 Lys et al.
6,897,624 B2 * 5/2005 Lys et al. ..... 315/297
7,508,303 B2 * 3/2009 Capowski et al. ..... 340/506
2004/0070513 A1 * 4/2004 Powell et al. ..... 340/815.4
2006/0232387 A1 10/2006 Curram et al.
2010/0102734 A1 * 4/2010 Quick et al. ..... 315/185 R

FOREIGN PATENT DOCUMENTS

GB 2244358 A 11/1991
WO 02087289 A1 10/2002
WO 2008052293 A1 5/2008

OTHER PUBLICATIONS

WO 2008052293 A1 (Quick et al) Light Emitting Diode Driver and Method, May 8, 2008.*
European Patent Office, European Search Report for Application No. 10159043.8-1232, Jul. 20, 2010, 7 pages.

* cited by examiner

*Primary Examiner* — Eric M Blount
(74) *Attorney, Agent, or Firm* — MH2 Technology Law Group, LLP

(57) ABSTRACT

Property monitoring system and method of operating. Two signal lines are used to couple a master controller in series with a plurality of indicators. Each indicator has a visual display. Each visual display has a plurality of LEDs, or other type of lighting device. The master controller is configured to generate a multi-bit digital command message to be transmitted serially to the plurality of indicators over the second signal line upon receipt of an alarm condition message. Each command message has a predetermined time delay for activating each of the indicators, or a component thereof, so that all indicators activate in unison.

15 Claims, 5 Drawing Sheets

SYSTEM AND METHOD OF CONTROLLING INDICATORS OF A PROPERTY MONITORING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

NAMES OF PARTIES TO A JOINT RESEARCH AGREEMENT

Not Applicable

REFERENCE TO A SEQUENCE LISTING, A TABLE, OR COMPUTER PROGRAM LISTING APPENDIX SUBMITTED ON COMPACT DISC

Not Applicable

BACKGROUND OF THE INVENTION

1. Field of the Invention

The field of the invention relates to property monitoring systems generally, and more particularly to certain new and useful advances in controlling visual information therefrom, of which the following is a specification, reference being had to the drawings accompanying and forming a part of the same.

2. Description of Related Art

Property monitoring systems, such as fire detection systems, life safety systems, intrusion detection systems, and the like, are critical components of many properties. Such monitoring systems, particularly those having a significant number of remote units, generally have a central control panel that is coupled with the remote units. The central control panel also has multiple indicators, each of which corresponds to a component of the monitoring system. In operation, each indicator provides visual and/or audible information about the system's status and/or about a location of an alarm event detected by one or more of the remote units. Examples of remote units include detectors, annunciators, and combinations thereof.

The diagram of FIG. 1 provides one example of how a control panel 10 is typically configured for use in a fire detection system. Each control panel indicator 18, 20, 22, and 24 has one or more LEDs 28 and one or more micro-controllers/integrated circuit ("IC") drivers 26. Each micro-controller/IC driver 26 controls the color and operation of its corresponding LED(s) 28 in response to commands received from a master controller 12.

Disadvantageously, the system 10 uses a relatively large number of lines 16, 30, 32, and 34 to connect the indicators 18, 20, 22, and 24 with a master controller 12, which includes a microprocessor 14. For example, a serial data line 16 connects the master controller 12 in series with each of the indicators 18, 20, 22, and 24. Additionally, each of an enable signal line 30, a clock signal line 32, and a synchronize signal line 34 couples the master controller 12 in parallel with each indicator 18, 20, 22, and 24.

Various methods are used to activate and/or operate the indicators 18, 20, 22, and 24. Such methods work for property monitoring systems that have a relatively small numbers of indicators, but, due to the extensive wiring requirements discussed above, are costly to implement when the number of indicators is significant. For example, in one method, the master controller sends out a synchronization message to all the indicators over the synchronize signal line 34. This synchronization message merely keeps the flashing of the LEDs in cadence with the master controller 12, and is sent out frequently to prevent drift in the cadence. In another method, in which each indicator 18, 20, 22, and 24 is equipped with a timer (not shown), the master controller 12 synchronizes the respective timers with a synchronization poll which is sent periodically when the indicators are operational causing the timers to reset to a nearest time interval.

Accordingly, a monitoring system and method of operating are needed, which reduce the number of wires that couple a master controller with multiple indicators.

BRIEF SUMMARY OF THE INVENTION

These and/or other disadvantages of the related art are addressed by an improved control panel for a property monitoring system, such as a fire detection system, a life safety system, an intrusion detection system, and the like. Advantageously, the improved control panel has fewer lines coupling a master controller with a plurality of indicators, each of which corresponds to a component of the property monitoring system. This lack of complex wiring allows for ease in repairing or swapping out indicators while the improved control panel is in operation.

The lack of complex wiring also allows for new and improved methods of signaling and/or operating the control panel indicators. For example, one such configuration and method enable the master controller to not only synchronize flashing of indicator LED's but also to ascertain an operating condition of each indicator. This ability to determine each indicator's operating condition not only allows for simplified troubleshooting and service, but also allows for reduction of false positives, e.g., situations where a faulty indicator generates an incorrect status of a system component and/or generates a false alarm.

Other features and advantages of the disclosure will become apparent by reference to the following description taken in connection with the accompanying drawings.

BRIEF DESCRIPTION OF THE DRAWINGS

Reference is now made briefly to the accompanying drawings, in which.

Like reference characters designate identical or corresponding components and units throughout the several views, which are not to scale unless otherwise indicated.

DETAILED DESCRIPTION OF THE INVENTION

As used herein, an element or function recited in the singular and proceeded with the word "a" or "an" should be understood as not excluding plural of said elements or functions, unless such exclusion is explicitly recited. Furthermore, references to "one embodiment" of the claimed invention should not be interpreted as excluding the existence of additional embodiments that also incorporate the recited features.

An improved control panel for a property monitoring system has a master controller with a microprocessor that is configured to generate a plurality of multi-bit digital command messages. Each command message has a predetermined time delay for activating and/or operating one or more indicators of the control panel and is sent serially to each indicator. Each indicator receives the command messages in a predetermined sequence with time delays for initiating activation and/or operation of each indicator, or a component thereof such as a LED and/or a speaker, simultaneously. The improved alarm control panel is able to provide these features using only a pair of communication lines that couple the master controller, in series, with the indicator.

Figure 5:
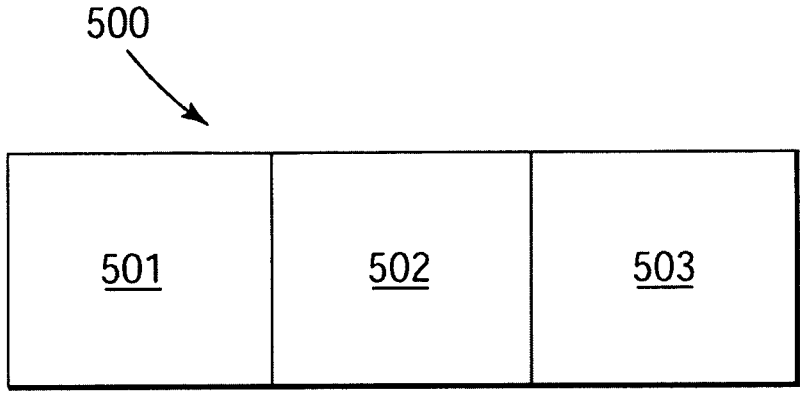
FIG. 5 illustrates an exemplary format of the command message from the master controller to the indicators.

As shown in FIG. 5, each command message 500 has at least an address field 501, a synchronization field 502, and an indicator component control field 503. The address field 501 is configured to contain a unique address of a desired recipient indicator. The synchronization field 502 is configured to contain data indicative of a predetermined time delay, upon the expiration of which the indicator, or a component thereof, will activate and/or operate as commanded by the master controller. The indicator component control field 503 is configured to contain a command from the master controller to operate a component of the indicator, such as an LED and/or a speaker, in a predetermined fashion—e.g., to display a predetermined color, to display a predetermined sequence of colors, to emit an audible alarm, to flash an LED in a predetermined pattern, and the like. Additionally or alternatively, the indicator component control field is configured to contain a command from the master controller to send an operational status of the indicator, and/or a component thereof, to the master controller.

Each indicator includes one or more components. Examples of such components include a micro-controller, a timer, a LED driver, an LED. One or more LED's, or other suitable type of lighting device, may be grouped and/or arranged together in any suitable manner to form a visual display for each indicator.

Figure 1:
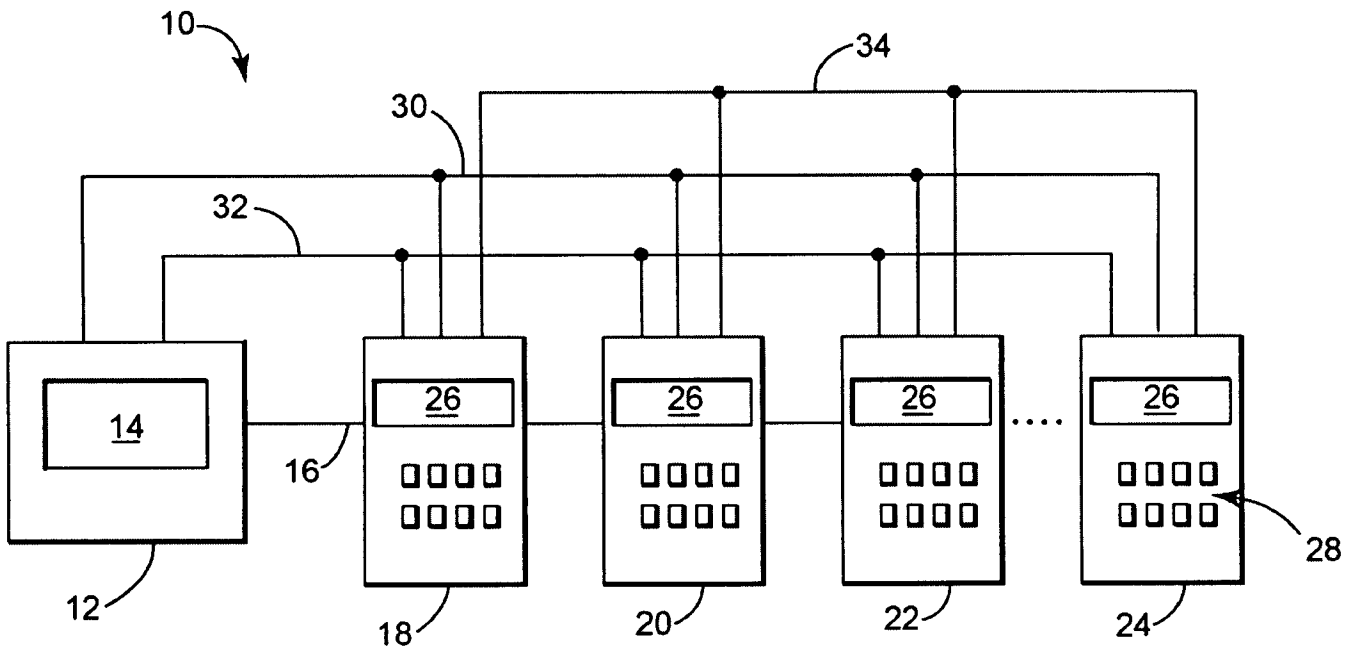
Fig. 1 (Prior Art)
FIG. 1 is block diagram of a prior control panel having a master controller coupled in parallel with multiple indicators via an enable signal line, a clock signal line, and a synchronize signal line.
Figure 2:
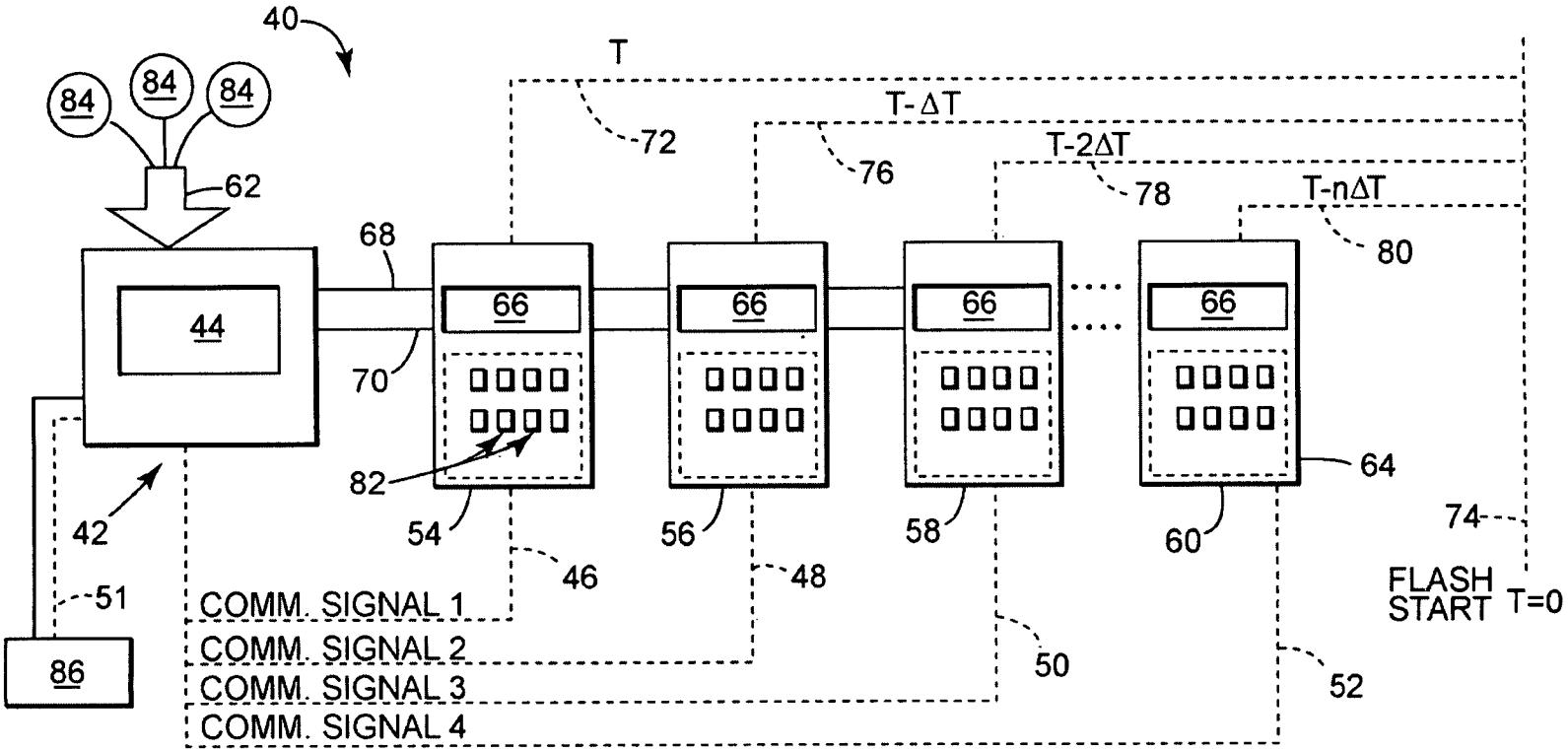
FIG. 2 is block diagram of an embodiment of the present invention having a control panel with a master controller and multiple indicators connected in series to a data line and a clock line.

FIG. 2 illustrates an improved control panel 40 of a property monitoring system. The control panel 40 has a master controller 42 that is serially coupled, via a first signal line 68 and a second signal line 70, with multiple indicators 54, 56, 58, and 60. The first signal line 68 is a clock signal line. The second signal line 70 is a data signal line. Each indicator 54, 56, 58, and 60 also has a visual display 64, which contains one or more LEDs 82 that are grouped and/or arranged in a predetermined pattern or fashion.

Each indicator 54, 56, 58, and 60 has a micro-controller (and/or one more LED drivers) 66 (hereinafter "micro-controller 66"). Each micro-controller 66 controls a color and/or operation of its corresponding LED(s) 82 in response to commands received from the master controller 42, which has a micro-processor 44 that is configured to generate one or more multi-bit command messages 46, 48, 50, and 52 sequentially over the second signal line 70.

A plurality of remote units 84 are coupled with the master controller 42 via lines 62. The remote units 84 are configured so that one or more them will activate upon the occurrence and detection of one or more predetermined alarm conditions, e.g., smoke detection, fire detection, public safety event, intrusion event, equipment malfunction, and the like. These predetermined alarm conditions are matched to certain colors, sounds, and/or text, so that an operator monitoring the improved control panel 40 can ascertain the type(s) and location(s) of detected alarm conditions. By way of example, and not limitation, a command message 46, 48, 50, 52 could instruct one or more LEDs 82 in one or more indicators 54, 56, 58, 60 to display red for fire, orange for smoke, blue for equipment malfunction, green for a normally operating remote unit (or system component), and so forth. Depending on the alarm condition, or operational status, a command message 46, 48, 50, 52 could instruct one or more LEDs 82 in one or more indicators 54, 56, 58, 60 to LEDs to flash in synchronization and/or at a predetermined rate—or example, 50 Hz. This flash rate is merely exemplary, it being contemplated that any suitable flash rate may be used.

Each command message 46, 48, 50, 52 has a predetermined time delay (T, T-ΔT, T-2ΔT, . . . , T-NΔT) for activating and/or operating LEDs 82 of the visual displays 64 in the indicators 54, 56, 58, 60. An audible alarm may also be included. The indicators 54, 56, 58, 60 receive the command messages 46, 48, 50, 52 in a predetermined sequence with time delays for activating and/or operating LEDs 82 of the visual displays 64 simultaneously.

In operation, upon a remote unit 84 detecting a given alarm condition, the master controller 42 generates and sends a first command message 46 to the first indicator 54. The time delay included in the first command message is noted as T 72. This initial time delay T 72 is predetermined based on the number of indicators and the time taken to input the command message into the micro-controller 66 and to initiate the LED latch command to flash. The lengths of the dotted lines representing the time delays in FIG. 2 indicate the remaining times till the flashing starts at $T_0$ 74. The second command message 48 decreases the time delay T 72 by a predetermined amount ΔT for a time delay of T-ΔT 76. For the third command message 50, the time delay is T-2ΔT 78, and for the nth indicator, the time delay would be T-(n-1)ΔT 80, but this would be equal to zero since the LEDs would latch and flash after the last device is set. In practice, the master controller 42 may indicate to the first LED card/module/alarm 54 to delay 15 milliseconds; the second LED alarm 56 to delay 14 milliseconds. The command message to the $15^{th}$ LED alarm would have no delay and instruct the indicator to latch the data without any delay. In this manner, the first to the last LED indicators would latch at T equals zero as indicated by dashed vertical line 74. The command message to each indicator has a unique time delay therein and is sent serially to each indicator through the second signal line 70.

Referring again to FIG. 2, each of indicators 54, 56, 58, 60 can be configured to detect and transmit a fault signal indicative of an operation fault of it and/or of one or more of its components to the master controller 42. Upon receiving the fault signal, the master controller 42 generates and sends a command message 51 to a display 86, such as an LCD display, on the control panel 40.

Figure 3:
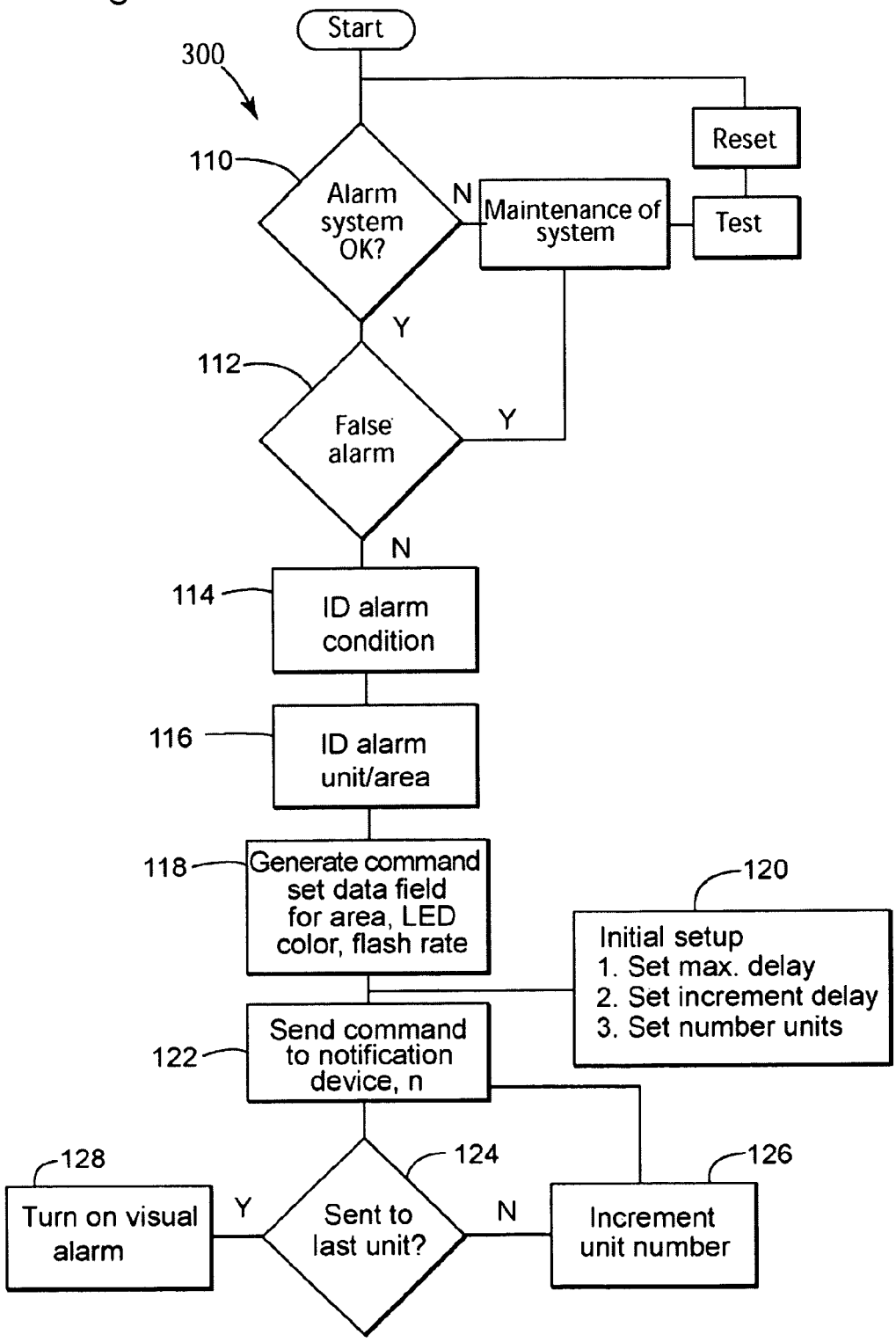
FIG. 3 is a flow chart of an improved method of signaling and/or operating one or more control panel indicators.

FIG. 3 is a flowchart illustrating a method 300 of operating the improved control panel of FIG. 2 for any suitable type of property monitoring system.

For purposes of illustration, and with reference back to FIG. 2, the method 300 begins at block 110, when the property monitoring system through internal tests is able to determine the proper functioning of remote units 84 and the control panel 40 itself. If any errors are detected, maintenance would be required to repair any problems. Before resetting of the property monitoring system after repair, a test would be initiated to confirm proper operating conditions of the relevant equipment.

As indicated by decision block 112, the method 300 determines, after an alarm is set off by one of the remote units, whether this is a false alarm or not. If the problem is a repairable item, a maintenance request is issued, and the property monitoring system is thereafter tested and reset.

When a valid alarm condition is detected by one of the remote units 84, the method 300 comprises identifying the alarm condition—e.g., as fire, smoke, equipment malfunction, public safety event, and the like—and/or determining what remote unit(s) 84 detected the alarm condition and/or the location(s) of the alarm conditions, as represented by blocks 114 and 116, respectively.

The microprocessor 44 knows from data in the alarm condition message received from the remote unit 84 which remote unit 84 responded to the alarm condition identifies the alarm location(s). As indicated by block 118, the microprocessor 44 generates and transmits a command message via the second signal line 70 to the indicators 54, 56, 58 and 60. As mentioned above, the command signal has appropriate information such as the address of the particular indicator to be activated, the type of LED color to activate, the flash rate, and the like.

As indicated by block 120, the method 300 relies on data inputted during an initial setup of the property monitoring system. This data includes, among other things, a maximum time delay T before activation of indicator LEDs 82, the amount of increment delay ΔT, the number of indicators 54, 56, 58, 60, the number of visual displays 64, etc. This may also be a count down time wherein a timer in the microcontroller 66 of the particular indicator 54, 56, 58, 60 starts incrementing downward the time until activation of the LED, or other indicator component.

As represented by blocks 122 and 126, the method 300 further includes incrementally decreasing the time delay ΔT based up each indicator's position in the chain of alerting. As indicated by blocks 124 and 128, after the last command message is sent to the last indicator unit the LEDs, and/or other indicator components, are commanded to latch on achieving a predetermined feature, e.g., a desired color, flash rate, tone, and the like.

Figure 4:
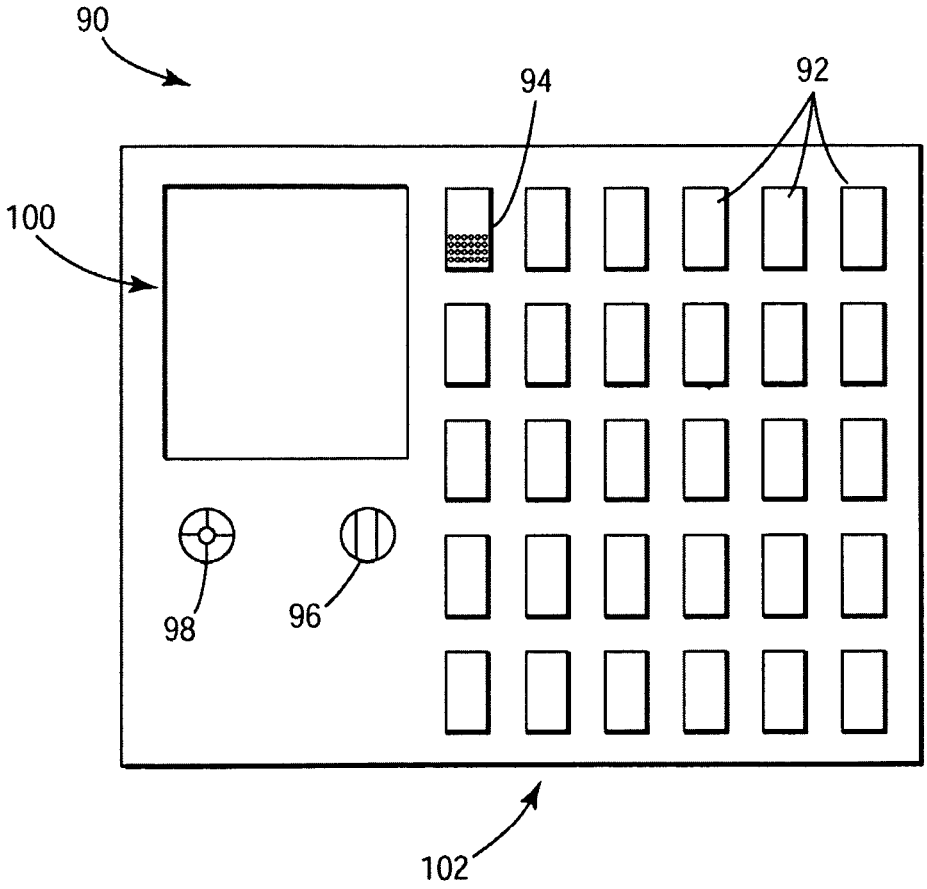
FIG. 4 illustrates simplified front view of an improved control panel.

As indicated above, many indicators 54, 56, 58 60 may be required for large properties, such as buildings, campuses, ships, and the like. FIG. 4 illustrates a front-view of an embodiment of an improved control panel 90. The control panel 90 has an output section 102 that may require hundreds of indicators 92 with LEDs (and/or other components) 94 These indicators 92 would not only be directed at priority alarm conditions such as fires, smoke, and equipment outages, but at other issues such as a security breach like open doors, open vaults, open storage areas, etc. The control panel 90 may include such features as a key lock 96, an audible alarm 98, and an input section 100 which may contain a keyboard, a display, a fire drill alert, a system reset after an alarm condition, an acknowledge to disable an alarm, an alarm silence to disable any notification functions, or just turn off the audible alarm, an alarm condition to indicate the source of the alarm such as fire, or smoke.

A property monitoring system constructed in accordance with the principles of the invention may comprise a first signal line, a second signal line, a plurality of indicators coupled, in series, to each of the first signal line and the second signal line, and a master controller. The master controller is configured to generate a multi-bit digital command message to be transmitted serially to the plurality of indicators over the second signal line. Each command message has a different predetermined time delay that is unique to each indicator of the plurality of indicators and that is configured to cause the plurality of indicators to activate in unison.

The master controller and the plurality of indicators may each be components of a control panel of the property monitoring system. Each indicator may be removably coupled with the control panel.

A method comprises receiving an alarm condition message from a remote unit coupled with a control panel of a property monitoring system; and sending at least two command messages to multiple indicators coupled with the control panel from a master controller based on the received alarm condition message. Each command message of the at least two command messages comprises at least a synchronization field having therein a predetermined time delay. The predetermined time delay is different for each command message. Also each indicator comprises a visual display; and a microcontroller configured to receive one of the at least two command messages and to drive a visual display based on the received command message.

A control panel configured for use in a property monitoring system, the control panel comprising a master controller coupled, in series, with a plurality of indicators. The master controller is configured to communicate alarm conditions received from one or more remote units. One type of remote unit is a smoke detector. Another type of remote unit is a CO2 detector. Another type of remote unit is an intrusion sensor. Another type of remote unit is a heat sensor. Another type of remote unit is a carbon monoxide detector. Another type of remote unit is a mass notification device. Each indicator has a visual display that alerts of the alarm condition and a microcontroller. The visual display is configured to display information received from one or more drivers communicating with the micro-controller. The microcontroller is configured to receive a predetermined command message from the master controller having a time delay therein unique to the microcontroller and its corresponding indicator. The visual display comprises one or more LEDs, and may be removable from the control panel. In one embodiment, the LEDS are arranged in groups, each group having a different color, and each color indicating a different alarm condition.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the scope of the following claims.

What is claimed is:

1. A property monitoring system, comprising:

a first signal line, wherein the first signal line is a clock signal line;

a second signal line, wherein the second signal line is a data signal line;

a plurality of indicators coupled, in series, to each of the first signal line and the second signal line;

a visual display of each of the plurality of indicators; and a microcontroller in each of the plurality of indicators that is configured to communicate with the visual display; and a master controller also coupled, in series, to each of the first signal line and the second signal line, wherein the master controller is configured to generate a multi-bit digital command message to be transmitted serially to the plurality of indicators over the second signal line, wherein each command message has a different predetermined time delay that is unique to each indicator of the plurality of indicators and that is configured to cause the plurality of indicators to activate in unison.

2. The property monitoring system of claim 1, wherein the master controller and the plurality of indicators are each components of a control panel.

3. The property monitoring system of claim 2, wherein each indicator is removably coupled with said control panel.

4. The property monitoring system of claim 1, wherein the visual display comprises a plurality of LEDS.

5. The property monitoring system of claim 4, wherein the plurality of LEDs is arranged in the visual display in groups, each group having a different color, wherein each color indicates a different alarm condition.

6. A method, comprising:

receiving an alarm condition message from a remote unit coupled with a control panel of a property monitoring system; and sending at least two command messages to multiple indicators coupled with the control panel from a master controller based on the alarm condition message, wherein:

each command message of the at least two command messages comprises at least a synchronization field having therein a predetermined time delay; and an indicator comprising:

a visual display; and a microcontroller configured to receive a command message of the at least two command messages and to control the visual display based on the command message.

7. The method of claim 6, wherein the predetermined time delay is different for each command message.

8. The method of claim 6, wherein the visual display comprises a plurality of LEDs.

9. The method of claim 8, wherein the plurality of LEDs is arranged in groups, each group having a different color LEDs, and each color indicating a different alarm condition.

10. A control panel configured for use in a property monitoring system, the control panel comprising:

a pair of signal lines;

a master controller coupled, in series, with a plurality of indicators via the pair of signal lines, wherein the master controller is configured to communicate alarm conditions received from one or more remote units, wherein each indicator of the plurality of indicators has a microcontroller and a visual display that is configured to alert of the alarm conditions, wherein the visual display is configured to display information received from one or more drivers communicating with the microcontroller, wherein the microcontroller is configured to receive a command message from the master controller, the command message having a time delay therein unique to the microcontroller and its corresponding indicator.

11. The control panel of claim 10, wherein an indicator of the plurality of indicators is removably coupled with the control panel.

12. The method of claim 10, wherein the visual display comprises a plurality of LEDs.

13. The method of claim 12, wherein the plurality of LEDs is arranged in groups, each group having a different color LEDs, and each color indicating a different alarm condition.

14. An indicator for use in a property monitoring system, the indicator comprising:

A microcontroller, the microcontroller having a timer that is configured to control timed operation of the indicator;

a visual display configured to alert of an alarm condition, wherein the visual display is configured to respond to the timer, when the timer receives a time delay unique to the indicator; and at least one driver operated by said microcontroller for operating a plurality of LEDs in said visual display in accordance with the time delay unique to the indicator.

15. The indicator of claim 14, wherein the plurality of LEDs is arranged in groups, each group having a different color LEDs, and each color indicating a different alarm condition.

* * * * *